US008388032B2

(12) United States Patent
Mamié et al.

(10) Patent No.: US 8,388,032 B2
(45) Date of Patent: Mar. 5, 2013

(54) TEXTILE PROTECTIVE SHEATH FOR A LIFTING ACCESSORY, AND ACCESSORY FOR LIFTING LOADS

(75) Inventors: André Mamié, Wädenswill (CH); Lars Dohse, Aachen (DE); Berthold Grundmann, Geilenkirchen (DE)

(73) Assignee: Spanset Inter AG, Wollerau (CH)

( * ) Notice: Subject to any disclaimer, the term of this patent is extended or adjusted under 35 U.S.C. 154(b) by 30 days.

(21) Appl. No.: 13/127,830

(22) PCT Filed: Oct. 29, 2009

(86) PCT No.: PCT/EP2009/064305

§ 371 (c)(1), (2), (4) Date: Aug. 8, 2011

(87) PCT Pub. No.: WO2010/052166

PCT Pub. Date: May 14, 2010

(65) Prior Publication Data

US 2012/0061980 A1 Mar. 15, 2012

(30) Foreign Application Priority Data

Nov. 7, 2008 (DE) ..... 10 2008 056 313

(51) Int. Cl.
*B66C 1/12* (2006.01)

(52) U.S. Cl. ..... 294/74; 442/203

(58) Field of Classification Search ..... 294/74; 442/203

See application file for complete search history.

(56) References Cited

U.S. PATENT DOCUMENTS

| | | | | |
|---|---|---|---|---|
| 4,177,839 | A * | 12/1979 | Kikuchi | 139/419 |
| 4,856,837 | A * | 8/1989 | Hammersla, Jr. | 294/74 |
| 5,238,278 | A | 8/1993 | Kamper | |
| 5,402,832 | A * | 4/1995 | Kamper et al. | 139/387 R |
| 5,839,479 | A * | 11/1998 | Gulya et al. | 139/383 A |
| 6,790,314 | B2 * | 9/2004 | Burazin et al. | 162/109 |
| 7,059,357 | B2 * | 6/2006 | Ward | 139/348 |
| 2004/0116020 | A1 * | 6/2004 | Boyd et al. | 442/203 |
| 2009/0051181 | A1 * | 2/2009 | Goossens et al. | 294/74 |
| 2011/0298231 | A1 * | 12/2011 | Dohse et al. | 294/74 |

FOREIGN PATENT DOCUMENTS

| | | | |
|---|---|---|---|
| EP | 0498253 | A1 | 8/1992 |
| WO | 2007/071310 | A1 | 6/2007 |

* cited by examiner

*Primary Examiner* — Saul Rodriguez
*Assistant Examiner* — Gabriela Puig
(74) *Attorney, Agent, or Firm* — The Webb Law Firm

(57) ABSTRACT

A textile protective sheath for a lifting accessory such as a roundsling, lifting strap or the like, having a woven base fabric and at least one rib which is carried by the woven base fabric, which rib projects outwards from the woven base fabric and is formed by a rib fiber which is interwoven with the woven base fabric, wherein the rib fiber is a high-performance fiber and, looking in the direction in which the rib fiber runs, the rib fiber skips at least three weft filaments at a time of the woven base fabric before it is drawn down below a weft filament of the woven base fabric.

23 Claims, 5 Drawing Sheets

TEXTILE PROTECTIVE SHEATH FOR A LIFTING ACCESSORY, AND ACCESSORY FOR LIFTING LOADS

BACKGROUND OF THE INVENTION

1. Field of the Invention

The invention relates to a protective sheath for a lifting accessory such as a roundsling, lifting strap or the like, the protective sheath being formed from a woven base fabric and having at least one rib which is carried by the woven base fabric, which rib projects outwards from the woven base fabric and is formed by a rib fibre which is interwoven with the woven base fabric.

The invention also relates to an accessory for lifting loads in which a protective sheath of this kind surrounds a core extending in the longitudinal direction of the lifting accessory which is formed from at least one fibre strand. Lifting accessories of this kind are typically roundslings, lifting straps or the like.

2. Description of Related Art

Lifting accessories of this kind are used to lift heavy loads. What is usually done in this case is that the given lifting accessory is passed around a projection from, or shoulder on, or opening in the object to be lifted and is then hooked into for example a hook on a crane. There is not, as a rule, any way of preventing at least parts of the lifting accessory from resting against the object to be lifted in this case. In the region where there is contact between the lifting accessory and the object to be lifted, there are high pressures per unit area and due to the relative movements which also occur at this point these result in increased wear. This is particularly critical when the lifting accessory is passed round a sharp edge or point.

In a situation like this, the protective sheath which surrounds the core of the lifting accessory is intended not only to prevent excessive abrasive wear but also to ensure that the core of the lifting accessory is not damaged by the high local loads.

Another function of protective sheaths of the kind being considered here is to protect the given lifting accessory against damage from cuts if it is not used properly, which damage may for example occur in the course of rough use on building sites if the lifting accessories are dragged over sharp-edged objects such as concrete reinforcing wires or the like or are run over by fork-lift trucks or other pieces of construction machinery.

To meet the requirements which exist in practical use, what have to date been used in practice are protective sheaths on the outside of which ribs extending in the longitudinal direction of the protective sheath are formed by weaving techniques and into which a reinforcement of textile wire is also woven. Lifting straps and roundslings which are provided with protective sheaths of this kind are known from EP 0 498 253 B1 and are offered for sale by the applicant on page 12 of its 2008 catalogues "Absturzsicherung" [Fall protection], "Heben" [Lifting], "Zurren" [Lashing] under the name "SupraPlus". When there are high pressures per unit area, the ribs present on the outside of a protective sheath of this kind prevent there from being an excessively high chafing load on the woven base fabric of the protective sheath, thus giving the lifting accessory a working life which is, overall, extended. At the same time, a textile wire which is woven into the woven base fabric is able to reinforce it in such a way that the protective sheath is also able to withstand high loads acting in its longitudinal direction safely.

One possible way of producing roundslings which will carry even higher loads is described in WO 2007/071310 A1.

The roundsling which is known from this publication has a core in which what are called high-performance fibres are included, and a protective sheath surrounding the core into which high-performance fibres are likewise worked. The ratio of the mass of the high-performance fibres in the core to the mass of the high-performance fibres in the protective sheath is to be 0.15 to 2.0 in this case. In the case of the roundsling known from WO 2007/071310 A1, what is intended to be obtained in this way is not only a particularly high lifting capacity but also high security against damage due to contact with sharp edges.

It is true that the roundsling known from WO 2007/071310 A1 does have improved lifting properties as a result of the high proportion of high-performance fibres which it has in its core and in its protective sheath which surrounds the core. However, the price which has to be paid for this is reduced flexibility and a commensurate worsening of its ease of handling. Practical studies are also showing that protective sheaths which, in the way disclosed in WO 2007/071310 A1, have a high proportion of high-performance fibres in their woven base fabric do not meet stringent requirement for protection against cuts caused by sharp-edged objects. Added to this is the fact that high proportions of high-performance fibres in the woven fabric of the protective sheath are found to be critical when the protective sheath is subjected to what is known as thermofixing.

Under the standards which apply to protective sheaths for lifting accessories, thermofixing of this kind is generally laid down for textile protective sheaths when there is a risk that, in the course of practical use, loops or other irregularities which might interfere with the protective function of the sheath may form in the textile fabric of the sheath. In the course of the thermofixing, adequate heating so consolidates the structure of the individual filaments in the woven fabric of the protective sheath that the filaments remain in their positions in the woven fabric even when the protective sheath is deformed in practical use. The woven fabric shrinks at the same time and the non-interwoven core surrounded by the protective sheath is thus more satisfactorily gripped. Finally, the thermofixing may also be deliberately employed to partially melt the synthetic fibres of a woven fabric and to bond them together. It has been found that, in the course of thermofixing of this kind, there is an appreciable reduction in the strength properties of high-performance fibres of the kind being considered. Also, a high proportion of high-performance fibres impedes the desired consolidation of the woven fabric of the protective sheath.

SUMMARY OF THE INVENTION

Against the background of the prior art explained above, the object of the invention lay in providing a protective sheath and a lifting accessory provided with such a protective sheath in which there is an assurance of optimised protection against cuts with, at the same time, good properties in use and the ability to be produced easily and inexpensively.

A textile protective sheath according to the invention for a lifting accessory has, as in the prior art, a woven base fabric and at least one rib which is carried by the base fabric, which rib projects outwards from the base fabric and is formed by a rib fibre which is interwoven with the base fabric.

In accordance with the invention, this rib fibre is then a high-performance fibre and this high-performance fibre is so interwoven with the woven base fabric that, looking in the direction in which the rib fibre runs, the rib fibre skips at least three weft filaments at a time of the woven base fabric before it is drawn down below a weft filament of the woven base fabric.

The protective sheath thus has, in accordance with the invention, a woven base fabric on which are formed ribs which, in a known fashion, extend in the longitudinal direction of the protective sheath and project outwards. What distinguishes the invention is the fact that these ribs are produced from high-performance fibres which are interwoven with the woven base fabric and of which individual portions, which rest freely on the woven base fabric, cross, when the warp is raised, at least three weft filaments at a time of the woven base fabric before they plunge back into the woven base fabric to be drawn down below at least one weft filament of the woven base fabric when the warp is depressed.

The pattern which is followed by the weaving-in of the high-performance fibres which form the ribs which are present in a given case is thus "at least over three, at least under one". In this way, the high-performance fibres which form the ribs which are present in a given case rest, portion by portion, relatively loosely on the woven base fabric. If the high-performance fibres come in contact with a cutting edge or a comparably sharp-edged object which acts in a similar way to a cutting edge, this makes it possible for them to move out of the way sideways in a direction directed transversely to the longitudinal extent of the ribs.

In the course of this movement out of the way, high-performance fibres of the rib which are arranged adjacent to one another are thrust against one another. This is particularly true when the ribs are each formed from at least two rib fibres.

Together, the high-performance fibres resting tightly against one another of a rib or of a plurality of adjacent ribs form a fibre bundle which is better able to withstand the given cutting edge than an individual fibre. Consequently, a protective sheath according to the invention provides appreciably improved protection against cuts without excessively large quantities of high-performance fibres having to be woven into the protective sheath for this purpose.

At the same time, the ribs which are formed in accordance with the invention from high-performance fibres form, in practical use, a surface for sliding on which the protective sheath can slide when, in use, it rests against the item to be lifted in the given case. The woven base fabric is protected against chafing loads in this way. Something which has a particularly beneficial effect in this case is the fact that high-performance fibres generally have a particularly smooth surface and hence good anti-friction properties.

What are considered to be "high-performance fibres" in the present case are synthetic polymer fibres which typically have a tensile strength of at least 150 cN/tex, and in particular of at least 200 cN/tex, and an elongation at break of less than 10%, and in particular of less than 5%. Examples of high-performance fibres of this kind are aramid fibres produced from aromatic polyamides which are commercially available under the brand name Twaron®, Kevlar® or Technora®. What also come within the term "high-performance fibres" are for example polybisoxazole fibres (PBO fibres), which are available under the brand name Zylon® for example, or fibres which are produced from ultra-high molecular weight polyethylene (UHMWPE) and which are designated high-performance polyethylene (HPPE) fibres and are commercially available under the brand-name Dyneema® or Spectra®.

What have proved particularly suitable for the invention are fibres composed of aromatic polyester or to be more exact liquid crystal polyester (LCP) which are offered for sale under the brand name Vectran® for example. These fibres have a combination which is ideal for the purposes of the invention of high load-bearing capacity even at temperatures of above 100° C., high resistance to flexing, high abrasion resistance, high purity if to be mixed with conventional polyester, an optimum high strengthening effect in textile tubular woven fabrics, and a degrading of its properties in the event of thermofixing which is only insignificant for the purposes of the invention.

The design according to the invention for a protective sheath turns out to be particularly advantageous when the protective sheath is subjected to thermofixing. In this way, the weaving-in of the high-performance fibres forming the ribs which is, in accordance with the invention, loose ensures that the high-performance fibres can still move relative to the woven base fabric in a direction directed transversely to their longitudinal extent even when the woven base fabric is consolidated into a firmly bonded structure by the thermofixing.

Particularly good protection against cuts can be achieved in a protective sheath according to the invention by having between each two weft filaments of the woven base fabric below which a rib fibre is drawn more than three, i.e. at least four and in particular at least five, weft filaments of the woven base fabric which are skipped by the rib fibres. In this embodiment, looking in the direction of the longitudinal extent of the ribs, the pattern which the weaving-in of the high-performance fibres follows is thus "over more than three, under at least one".

An optimum effect from the ribs which are formed in accordance with the invention from high-performance fibres is obtained if there are, between each two weft filaments of the woven base fabric below which a rib fibre is drawn, not more than ten weft filaments of the woven base fabric which are skipped by the rib fibre. Practical trials have shown that optimum protection against cuts can be achieved if, looking in the direction in which the rib fibre runs, the rib fibre skips a maximum of seven weft filaments of the woven base fabric at a time before it was drawn down below a weft filament of the woven base fabric. This type of weaving-in according to the invention also ensures that there is no forming of loops.

An embodiment of the invention which is particularly suitable for practical use is characterised in that a protective sheath according to the invention has a plurality of ribs whose rib fibres each comprise high-performance fibres. In line with the particular purpose of use, it will in many cases be beneficial in this case if the ribs are arranged to be distributed around the circumference of the protective sheath at regular intervals. This applies for example when it cannot be predicted at what point there will, in practice, be contact between the protective sheath and the article to be moved in the given case. This is for example the case when a roundsling serving as a lifting accessory is provided with a protective sheath according to the invention.

If a rib is formed from at least two high-performance fibres, an optimum protective effect against cuts is obtained if the fibres of a rib are drawn through out of step, i.e. under different respective weft filaments of the woven base fabric. In the event of an assault of a cutting nature, a staggered arrangement of this kind is a particularly certain way of achieving the bundling together of the high-performance fibres which is aimed for.

The fibres of the woven base fabric may be composed of a conventional fibre material such for example as a polyester of high toughness. However, the woven base fabric too may make a contribution to improving the protection against cuts.

For this purpose, at least some of the weft filaments of the woven base fabric for example may comprise high-performance fibres. With a view to an ability to be produced easily, the high-performance filaments acting as weft filaments are preferably so arranged that these weft filaments comprising high-performance fibres are present in the woven base fabric spaced at regular intervals from one another.

To ensure that the high-performance fibre yarns which are provided for the purpose of inhibiting cuts satisfactorily in accordance with the invention have the mobility they need for this purpose, the set or density of the warp filaments, which is usually uniform across the width of the woven base fabric, may also be varied in such a way that a lower set is present in the region close to the high-performance fibres of the ribs than in the rest of the woven base fabric. For this purpose, there may be provided around the ribs a rib region in which the warp filaments of the woven base fabric are more mobile transversely to their longitudinal extent than the warp filaments of the woven base fabric which are arranged outside the rib region. Then, in the rib region, at least two of the warp filaments of the woven base fabric which are present there may be at a spacing relative to one another which is greater than the spacing at which the warp filaments are arranged relative to one another outside the rib region concerned.

A grip for the ribs which is particularly secure in the normal state with, at the same time, particularly good mobility for the high-performance fibres which form the rib in the given case is obtained in this case if the rib is supported within the rib region in each case by at least one warp filament of the woven base fabric whose spacing from that warp filament of the woven base fabric which is adjacent to it and which is arranged to be offset towards whichever boundary of the rib region is concerned is greater than the spacing relative to one another of the warp filaments of the woven base fabric which are arranged outside the rib region.

An alternative or supplementary way of making possible the mobility which is aimed at in accordance with the invention for the high-performance fibres of the ribs is, in the rib region, for at least those warp filaments of the woven base fabric which are most closely adjacent to the given rib to have an ability to slide, due to the nature of their surface, which is greater than the ability to slide of the warp filaments of the woven base fabric which are arranged outside the rib region. The idea underlying this embodiment is that, if there is a cutting load, not only the high-performance fibres of the ribs which are loaded in the given case but also the associated warp filaments of the woven base fabric are able to move out of the way sideways, in order to make it possible in this way for the high-performance fibre to have the maximum mobility. In practice, this can for example be achieved by providing the warp filaments of the woven base fabric which are arranged in the rib region and which have an increased ability to slide with a flocked finish for the purpose of increasing their ability to slide. The bristles of the yarn of the woven base fabric which has been flocked in this way project in the radial direction and if a cutting load occurs they yield, thus enabling the high-performance yarn of the ribs to sink into the woven base fabric.

Another possible way of optimising the mobility for the purposes of the invention of the high-performance fibre which is used to produce the given rib is to coat the high-performance fibre with a lubricant. This may for example be an oil, and in particular a silicone oil, or some other kind of silicone coating.

DETAILED DESCRIPTION OF THE INVENTION

Figure 1:
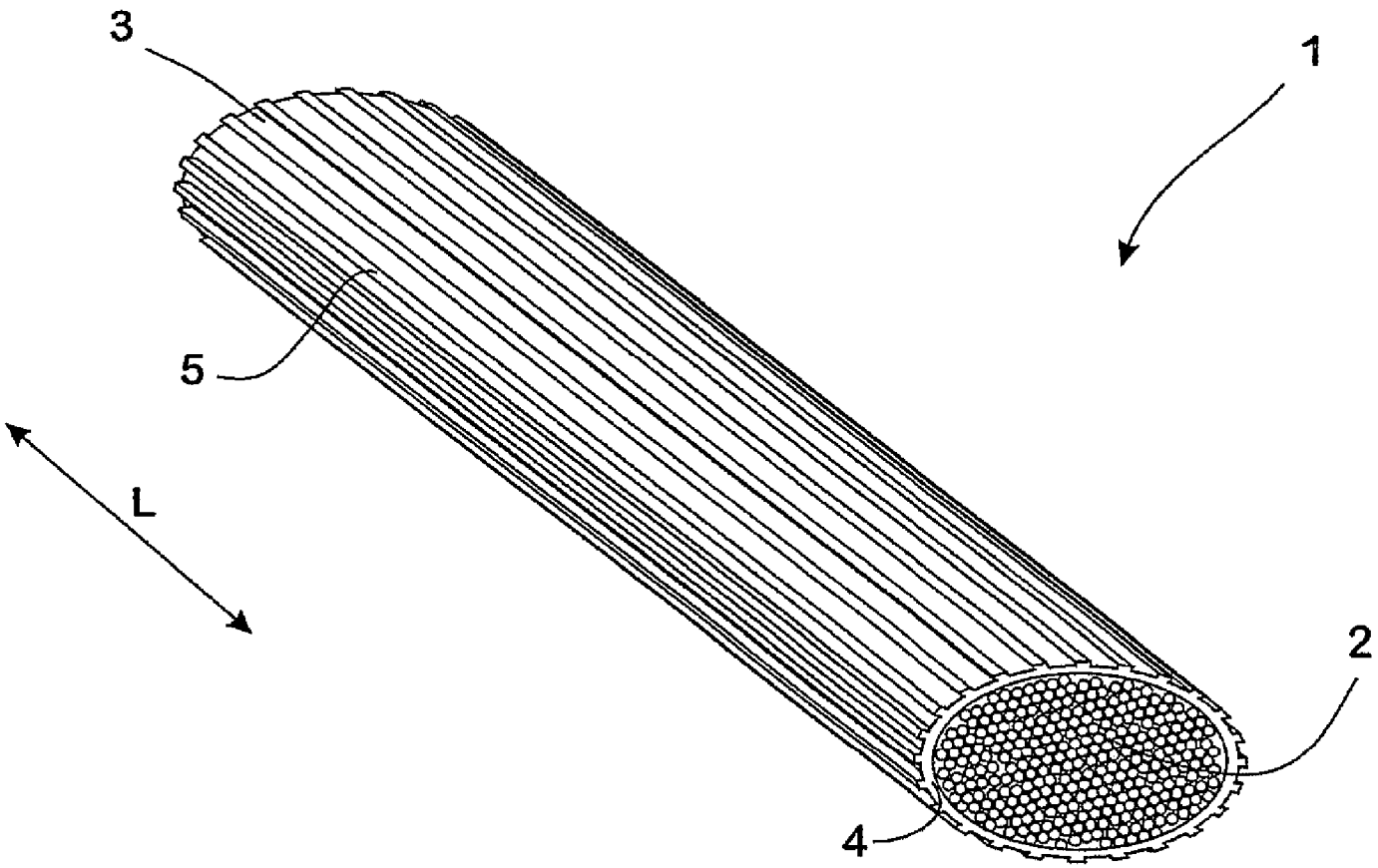
FIG. 1 is a perspective view of a portion of a roundsling having a protective sheath.

The roundsling 1 of which only a portion is shown in FIG. 1 has, in a known manner, a non-interwoven core 2 formed by a plurality of individual fibres which is surrounded by a textile protective sheath 3.

The protective sheath 3, which is thermofixed, is formed by a woven base fabric 4 which carries on its outside ribs 5 which project outwards radially, which ribs 5 extend in the longitudinal direction L of the protective sheath 3 and are arranged to be distributed at regular intervals around the circumference of the protective sheath 3.

The weft filaments 6 and warp filaments 7 which form the woven base fabric 4 are composed in the conventional way of commercially available polyester fibres of high toughness having a tensile strength of 70 cN/tex, an elongation at break of 19%, a high flexibility in bending, an average abrasion resistance, a high resistance to UV and a maximum temperature of use of 150° C. Such polyester fibres are commercially available under the name "Performance Fibers® T710". To improve their mobility, the high-performance fibres may be provided with a silicone coating.

Alternatively, some or all of the weft filaments 6 of the woven base fabric may also comprise high-performance fibres.

In the woven base fabric 4, the warp filaments 7, which are merely indicated by dotted lines in the present case for the sake of clarity, pass alternately over and under the weft filaments 6.

The ribs 5 which are carried by the woven base fabric 4 are each formed by two rib fibres H1, H2, in the form of high-performance fibres, which extend in parallel.

The high-performance fibres which may possibly be worked into the woven base fabric 4 and the rib fibres H1, H2 in the form of high-performance fibres in the ribs 5 are each composed of an aromatic polyester, or to be more exact a liquid crystal polymer (LCP), such as is commercially available under the brand name "Vectran® HS T97". They have a high tensile strength of 200 cN/tex, an elongation at break of 3.3%, a high flexibility in bending, a high abrasion resistance, a high resistance to UV and a maximum temperature for use of 195° C.

Figure 2:
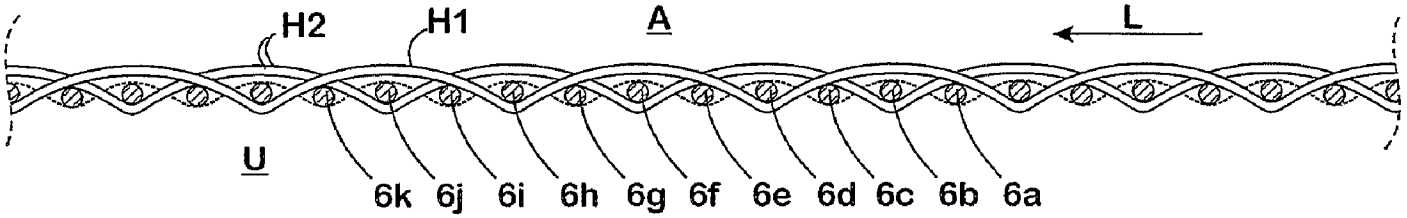
FIG. 2 shows a detail in longitudinal section of a first variant of the protective sheath shown in FIG. 1.

In the "over 3, under 1" weave pattern variant which is shown in FIG. 2, a regular pattern is followed in which a rib fibre H1 which rests on the outside A of the woven base fabric skips three weft filaments 6*a*, 6*b*, 6*c* at a time when the warp is raised, before passing to the underside U of the woven base fabric 4 and being drawn down below the next weft filament 6*d* when the warp is depressed, before then at once passing back to the outside A of the woven base fabric 4, and so on. Out of step by a stagger of two weft filaments 6*a*, 6*b* relative to the first rib fibre H1, the second rib fibre H2 follows the same pattern and skips three weft filaments 6*c*, 6*d*, 6*e* before passing to the underside U of the woven base fabric 4 and being drawn down below the next weft filament 6*f*, before then at once passing back to the outside A of the woven base fabric 4, and so on.

Figure 3:
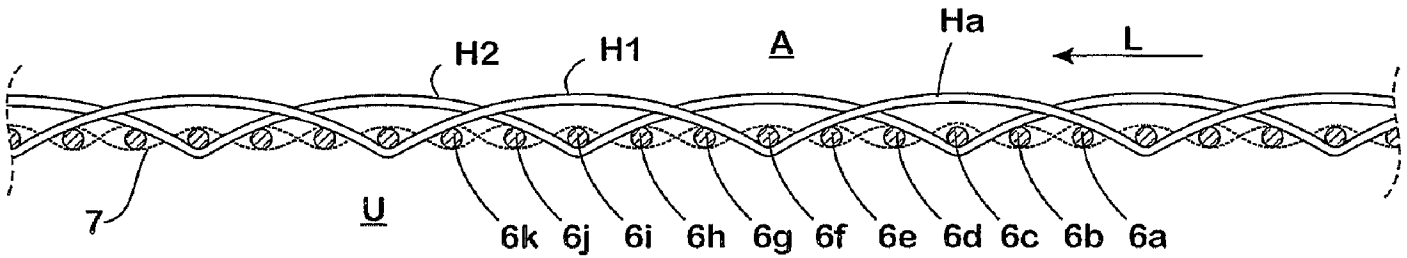
FIG. 3 shows a detail in longitudinal section of a second variant of the protective sheath shown in FIG. 1.

In the "over 5, under 1" weave pattern variant which is shown in FIG. 3, a regular pattern is followed in which a rib fibre H1 which rests on the outside A of the woven base fabric 4 skips five weft filaments 6*a*-6*e* at a time when the warp is raised, before passing to the underside U of the woven base fabric 4 and being drawn down below the next weft filament 6*f* when the warp is depressed, before then at once passing back to the outside A of the woven base fabric 4, and so on. Out of step by a stagger of three weft filaments 6*a*-6*c* relative to the first rib fibre H1, the second rib fibre H2 follows the same pattern and skips five weft filaments 6*d*-6*h* before passing to the underside U of the woven base fabric 4 and being drawn down below the next weft filament 6*i*, before then at once passing back to the outside A of the woven base fabric 4, and so on.

Figure 4:
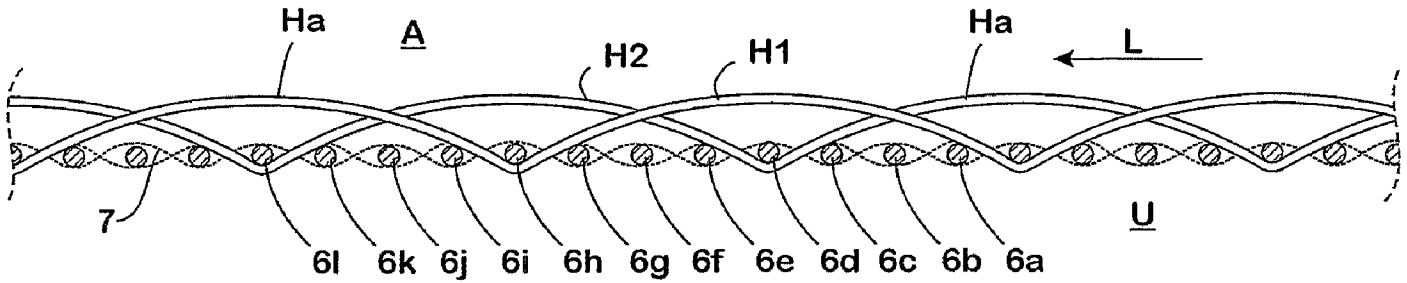
FIG. 4 shows a detail in longitudinal section of a third variant of the protective sheath shown in FIG. 1.

In the "over 7, under 1" weave pattern variant which is shown in FIG. 4, a regular pattern is followed in which a rib fibre H1 which rests on the outside A of the woven base fabric 4 skips seven weft filaments 6*a*-6*g* at a time when the warp is raised, before passing to the underside U of the woven base fabric 4 and being drawn down below the next weft filament 6*h* when the warp is lowered before then at once passing back to the outside A of the woven base fabric 4, and so on. Out of step by a stagger of four weft filaments 6*a*-6*d* relative to the first rib fibre H1, the second rib fibre H2 follows the same pattern and skips seven weft filaments 6*e*-6*k* before passing to the underside U of the woven base fabric 4 and being drawn down below the next weft filament 6*l*, before then at once passing back to the outside A of the woven base fabric 4, and so on.

Figure 7:
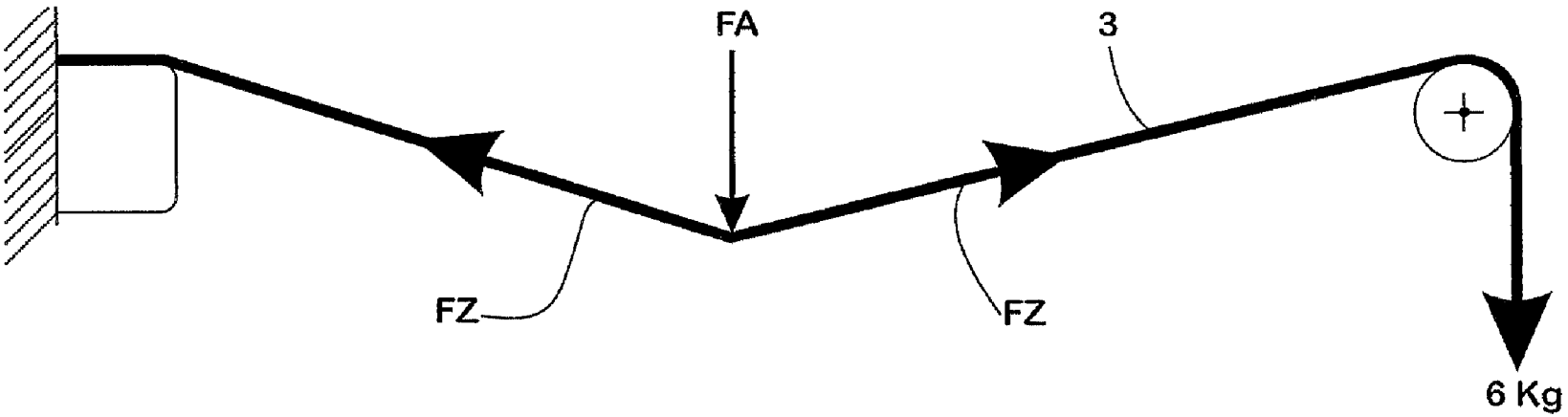
FIG. 7 shows a test rig to examine the cut resistance of samples of the variants constructed as shown in FIGS. 2 to 4 of a protective sheath as shown in FIG. 1.

With the test rig shown in FIG. 7, tests have been carried out in which a blade aligned transversely to the longitudinal extent L of the specimens was brought down at an angle of approximately 20° onto specimens of protective sheaths respectively constructed with the variant weaves shown in FIGS. 2 to 4. The tensile force FZ exerted on the specimens in this case was approximately 58 daN whereas the applied compressive force FA from the blade was approximately 32 daN. The tests showed that severing of the rib fibres H1, H2 occurred after an average of 2641 cutting strokes in the case of the "over 3, under 1" variant (FIG. 2), that severing of the rib fibres H1, H2 occurred after an average of 3721 cutting strokes in the case of the "over 5, under 1" variant (FIG. 3), and finally that severing of the rib fibres H1, H2 occurred after an average of 15,196 cutting strokes in the case of the "over 7, under 1" variant (FIG. 4).

However, in the specimens tested, the superior cut resistance of the "over 7, under 1" variant contrasted with the fact that the rib fibres H1, H2 forming the ribs 5 tended to form loops in the region of their portions Ha which rested on the outside A of the woven base fabric 4, which loops may, in practical use, catch on projections from the item being lifted and may thus result in damage to the protective sheath 3. Under the conditions which have been described here for the use of a "lifting accessory", and in particular a "roundsling", those variants are therefore considered optimum in which the rib fibres H1, H2 are woven into the woven base fabric 4 following the "over 4, under 1", "over 5, under 1", or "over 6, under 1" pattern, the primary factor in the case of the "over 4, under 1" variant being the firmness with which the fibres are woven with simply good cut resistance, whereas while the firmness with which the fibres are woven in is still adequate in the case of the "over 6, under 1" pattern there is maximum protection against cuts, and in the case of the "over 5, under 1" variant there is a balanced relationship between optimised weaving-in and high cut resistance.

Figure 5:
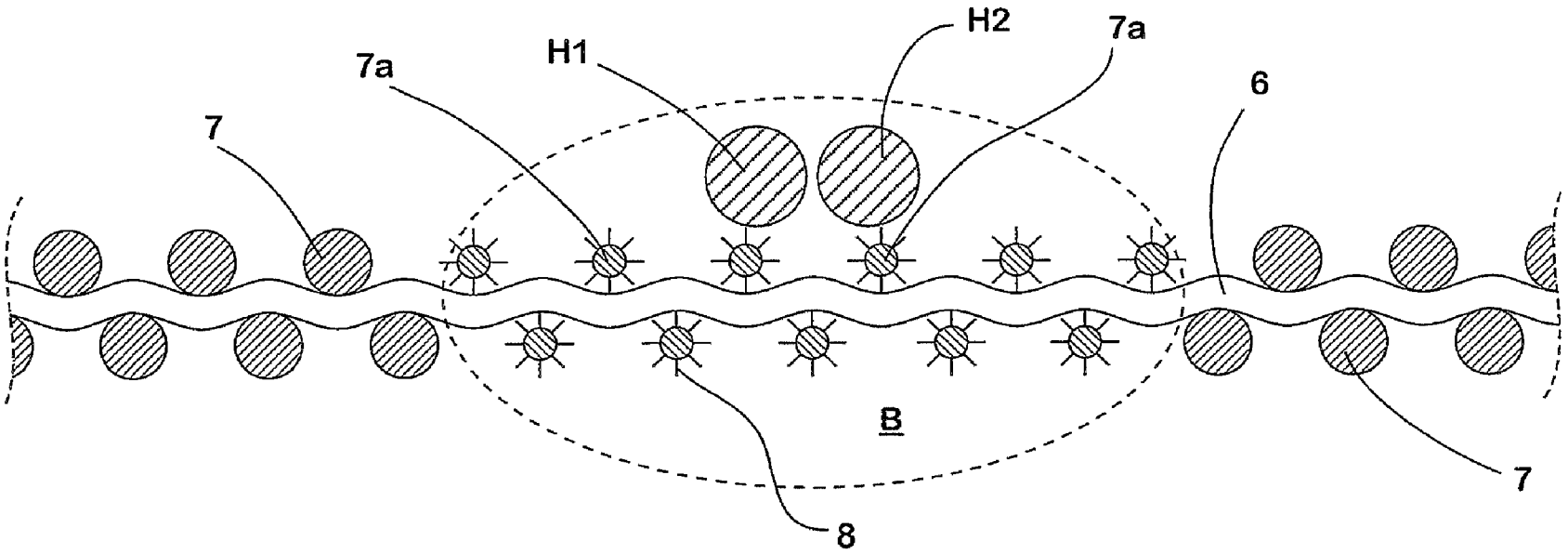
FIG. 5 shows a detail in cross-section of a further variant of the protective sheath shown in FIG. 1.

In the case of the variant shown in FIG. 5, the warp filaments 7*a* which are arranged in a rib region B extending laterally from the rib fibres H1, H2 making up the given rib 5 are provided with flocked finish. In the normal state, the rib fibres H1, H2 rest on the bristles 8 projecting radially from the flocked warp filaments. At the same time, the bristles 8 hold the warp filaments 7, 7*a* arranged adjacent to one another at a defined spacing. If there is a cutting load on the rib fibres H1, H2, the bristles 8 yield under the pressure which arises in this case and the rib fibres H1, H2 are able to move out of the way transversely to the longitudinal direction L until they form a fibre bundle which offers a maximum resistance to the cutting load.

Figure 6:
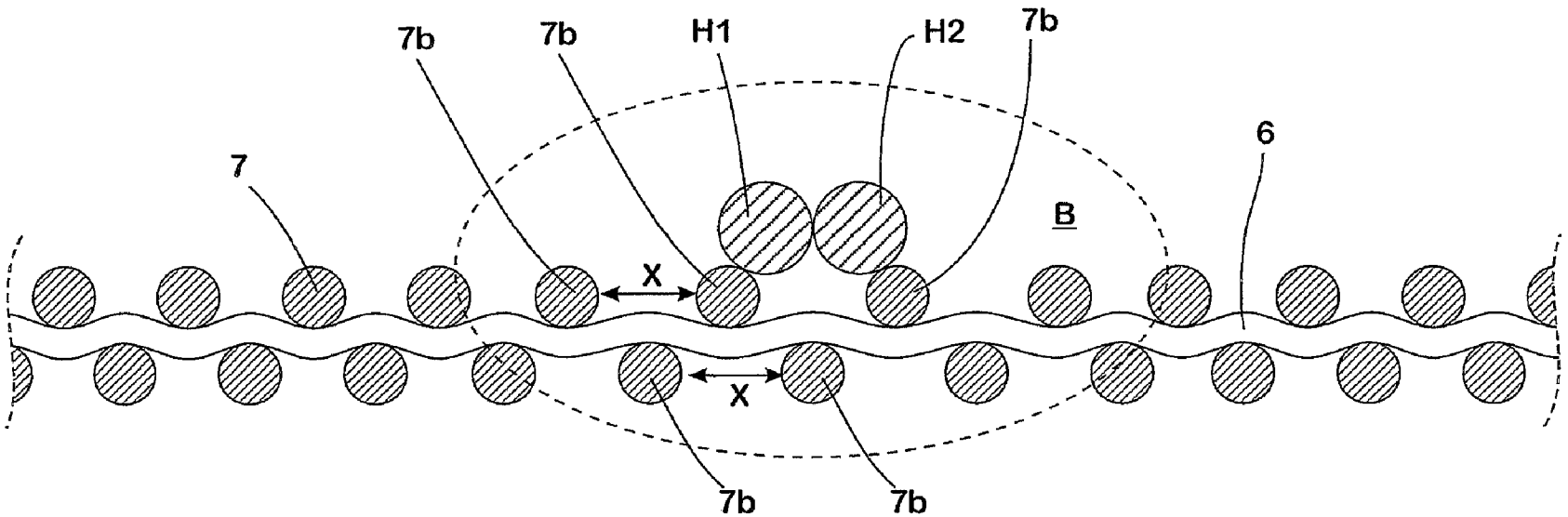
FIG. 6 shows a detail in cross-section of a fifth variant of the protective sheath shown in FIG. 1.

The fifth variant, which is shown in FIG. 6, is based on the same principle. In this variant, the warp filaments 7*b* of the woven base fabric 4 which support the rib fibres H1, H2 are arranged, in a region B in the centre of which the rib 5 is situated, at a greater spacing X from the warp filaments 7 arranged most closely adjacent than they are outside the rib region B. In this way, the warp filaments 7*b* are likewise able to move out of the way when there is a cutting load on the rib fibres H1, H2 and the rib fibres H1, H2 thus hunch together into a bundle and offer the optimum resistance to the cutting force.

REFERENCE NUMERALS

1 Roundsling
2 Non-interwoven core
3 Protective sheath
4 Woven base fabric
5 Ribs
6, 6*a*-6*l* Weft filaments
7, 7*a*, 7*b* Warp filaments
8 Bristles
A Outside of the woven base fabric 4
B Rib region
Ha Portions of the rib fibres H1, H2 which rest on the outside A of the woven base fabric 4
H1, H2 Rib fibres
L Longitudinal direction of the protective sheath 3
U Underside of the woven base fabric 4
X Spacing

The invention claimed is:

1. A textile protective sheath for a lifting accessory such as a roundsling, lifting strap or the like, comprising a woven base fabric and at least one rib which is carried by the woven base fabric, which rib projects outwards from the woven base fabric and is formed by a rib fibre which is interwoven with the woven base fabric, wherein the rib fibre is a high-performance fibre and in the direction in which the rib fibre runs, the rib fibre skips at least three weft filaments at a time of the woven base fabric before it is drawn down below a weft filament of the woven base fabric.

2. The textile protective sheath according to claim 1, wherein, looking in the direction in which the rib fibre runs, the rib fibre skips more than three weft filaments at a time of the woven base fabric before it is drawn down below a weft filament of the woven base fabric.

3. The textile protective sheath according to claim 2, wherein, looking in the direction in which the rib fibre runs, the rib fibre skips at least five weft filaments at a time of the woven base fabric before it is drawn down below a weft filament of the woven base fabric.

4. The textile protective sheath according to claim 1, wherein, looking in the direction in which the rib fibre runs, the rib fibre skips not more than ten weft filaments at a time of the woven base fabric before it is drawn down below a weft filament of the woven base fabric.

5. The textile protective sheath according to claim 4, wherein, looking in the direction in which the rib fibre runs, the rib fibre skips not more than seven weft filaments at a time of the woven base fabric before it is drawn down below a weft filament of the woven base fabric.

6. The textile protective sheath according to claim 1, comprising a plurality of ribs whose rib fibres each consist of high-performance fibres.

7. The textile protective sheath according to claim 6, wherein the ribs are arranged to be distributed around the circumference of the protective sheath at regular intervals.

8. The textile protective sheath according to claim 1, wherein the ribs are each formed from at least two rib fibres.

9. The textile protective sheath according to claim 8, wherein the rib fibres of a rib are drawn through out of step below different respective weft filaments of the woven base fabric.

10. The textile protective sheath according to claim 1, wherein warp filaments and at least some of the weft filaments of the woven base fabric are composed of a polyester yarn.

11. The textile protective sheath according to claim 1, wherein at least some of the weft filaments of the woven base fabric comprise high-performance fibres.

12. The textile protective sheath according to claim 11, wherein the weft filaments comprising high-performance fibres are present in the woven base fabric spaced at regular intervals from one another.

13. The textile protective sheath according to claim 1, wherein the high-performance fibres are produced from a polymeric plastics material, a polymeric polyester, an aromatic polyester or a liquid crystal polymer.

14. The textile protective sheath according to claim 1, wherein the ribs are surrounded by a rib region in which the warp filaments of the woven base fabric are more mobile transversely to their longitudinal extent than warp filaments of the woven base fabric which are arranged outside the rib region.

15. The textile protective sheath according to claim 14, wherein, in the rib region, at least two of the warp filaments of the woven base fabric which are present there are at a spacing relative to one another which is greater than the spacing at which the warp filaments are arranged relative to one another outside the rib region concerned.

16. The textile protective sheath according to claim 14, wherein the rib is supported within the rib region in each case by at least one warp filament of the woven base fabric whose spacing from the warp filament of the woven base fabric which is adjacent to it and which is in each case arranged to be offset towards whichever boundary of the rib region is concerned is greater than the spacing relative to one another of the warp filaments of the woven base fabric which are arranged outside the rib region.

17. The textile protective sheath according to claim 14, wherein, in the rib region, at least those warp filaments of the woven base fabric which are most closely adjacent to the given rib have an ability to slide, due to the nature of their surface, which is greater than the ability to slide of the warp filaments of the woven base fabric which are arranged outside the rib region.

18. The textile protective sheath according to claim 17, wherein the warp filaments of the woven base fabric which are arranged in the rib region and which have an increased ability to slide are provided with a flocked finish for the purpose of increasing their ability to slide.

19. The textile protective sheath according to claim 1, wherein the protective sheath is thermofixed.

20. The textile protective sheath according to claim 1, wherein the high-performance fibres are coated with a medium which increases their ability to slide.

21. The textile protective sheath according to claim 20, wherein the high-performance fibres are coated with an oil.

22. An accessory for lifting loads comprising a load-bearing core formed by at least one fibre strand and a textile protective sheath, a textile protective sheath comprising a woven base fabric and at least one rib which is carried by the woven base fabric, which rib projects outwards from the woven base fabric and is formed by a rib fibre which is interwoven with the woven base fabric, wherein the rib fibre is a high-performance fibre and in the direction in which the rib fibre runs, the rib fibre skips at least three weft filaments at a time of the woven base fabric before it is drawn down below a weft filament of the woven base fabric.

23. The accessory according to claim 22, wherein the accessory is a roundsling.

* * * * *

UNITED STATES PATENT AND TRADEMARK OFFICE

CERTIFICATE OF CORRECTION

PATENT NO. : 8,388,032 B2
APPLICATION NO. : 13/127830
DATED : March 5, 2013
INVENTOR(S) : André Mamié et al.

It is certified that error appears in the above-identified patent and that said Letters Patent is hereby corrected as shown below:

ON THE TITLE PAGE:

Item (75) Inventors, Line 1, delete "Wädenswill" and insert -- Wädenswil --

IN THE CLAIMS:

Column 10, Line 9, Claim 16, after "one" delete "another"

Signed and Sealed this
Third Day of September, 2013

Teresa Stanek Rea
*Acting Director of the United States Patent and Trademark Office*

UNITED STATES PATENT AND TRADEMARK OFFICE

CERTIFICATE OF CORRECTION

PATENT NO. : 8,388,032 B2
APPLICATION NO. : 13/127830
DATED : March 5, 2013
INVENTOR(S) : Mamié et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 121 days.

Signed and Sealed this
First Day of September, 2015

Michelle K. Lee

Michelle K. Lee
*Director of the United States Patent and Trademark Office*